United States Patent [19]

Ruga

[11] 4,145,149

[45] Mar. 20, 1979

[54] ANGLE PLATE CONNECTOR FOR TUBULAR MEMBERS

[76] Inventor: Wayne Ruga, 2163-D Coosawattee Rd., Atlanta, Ga. 30319

[21] Appl. No.: 863,718

[22] Filed: Dec. 23, 1977

Related U.S. Application Data

[63] Continuation-in-part of Ser. No. 705,885, Jul. 16, 1976.

[51] Int. Cl.[2] ..... F16B 7/04; F16D 1/00; F16D 3/00

[52] U.S. Cl. ..... 403/217; 403/171; 403/176; 52/81; 403/406

[58] Field of Search ..... 403/217, 169, 170, 171, 403/172, 173, 174, 176, 178, 231, 406; 52/80, 81

[56] References Cited

U.S. PATENT DOCUMENTS 4,065,220 12/1977 Ruga ..... 403/169

FOREIGN PATENT DOCUMENTS 704346 2/1965 Canada ..... 403/171

2111532 9/1971 Fed. Rep. of Germany ..... 403/217

62962 4/1949 Netherlands ..... 403/217

7704886 7/1976 Netherlands ..... 403/217

838537 6/1960 United Kingdom ..... 403/170

*Primary Examiner*—Wayne L. Shedd

*Attorney, Agent, or Firm*—B. J. Powell

[57] ABSTRACT

An interlocking structural system comprising a plurality of tubular strut members defining a central opening in the ends thereof of a prescribed diameter and at least one connector for selectively interconnecting the tubular strut members, the connector including one or more plate members with a plurality of connector tangs thereon generally radially oriented with respect to the plate member where one set of alternate connector tangs angle away from the plane of the plate member and where another set of alternate connector tangs lie in the plane of the plate member with the connector tangs sized to be recieved in the central opening in the end of one of the strut members so that the strut member can be slipped over any one of the connector tangs to connect the strut member to the connector.

7 Claims, 6 Drawing Figures

ANGLE PLATE CONNECTOR FOR TUBULAR MEMBERS

CROSS-REFERENCE TO RELATED APPLICATIONS

This application is a continuation-in-part of my copending application Ser. No. 705,885, filed July 16, 1976.

BACKGROUND OF THE INVENTION

A number of skeletal structural systems are currently available which use strut members that are interconnected through connectors. One of the problems commonly associated with such structural systems is the use of relatively specialized connectors to connect the strut members to form the structure. This has resulted in limiting the number of structural configurations available using such connectors or having required a number of different type connectors designed to connect the strut members together in a particular configuration. Another problem that has been associated with these prior art structural systems is that the configuration of the connectors was of a fixed design which did not lend themselves to be rearranged to interlock the strut members in different configurations. Yet another problem that has been associated with prior art structural systems is that it was difficult to economically manufacture such a system while at the same time keeping the weight of the system at a minimum. Still another problem with such prior art structural system is that the entire connector must be used even though only a portion of it is needed to form a structural joint.

SUMMARY OF THE INVENTION

These and other problems and disadvantages associated with the prior art are overcome by the invention disclosed herein by providing a skeletal structural system using tubular strut members which are interlocked together through a universal type connector that allows a wide variety of structural configurations without the use of specialized components. Further, the weight of the system is minimized while at the same time minimizing the cost thereof because of the wide range of interchangeable components. Further, the connector which interlocks the tubular strut members of the system can be rearranged to different configurations to meet the required structural configuration. Also, only that portion of the connector actually used to form the structural joint is required rather than the entire connector.

The structural system of the invention comprises generally a universal type connector in which the configuration thereof can be rearranged to permit the connector to interlock the tubular strut members of the structural system in different system configurations. Each connector comprises one or more plate elements which provide connection points for the tubular strut members to form the structural system. The strut members may also serve to lock portions of the connector together. This provides a structural system with a miximum number of degrees of freedom to provide an extremely wide variation in structural configurations. The plate elements may be assembled in different configurations and with different numbers of plate elements. Further, the connectors may be shipped disassembled to occupy the minimum space.

These and other features and advantages of the invention will become more clearly understood upon consideration of the following specification and accompanying drawings wherein like characters of reference designate corresponding parts throughout the several views and in which:

These figures and the following detailed description disclose specific embodiments of the invention; however, it is to be understood that the inventive concept is not limited thereto since it may be embodied in different forms.

DETAILED DESCRIPTION OF ILLUSTRATIVE EMBODIMENTS

Referring to FIGS. 1–6, it will be seen that the structural system of the invention includes a connector 10 which is used to interconnect a plurality of tubular strut members 11 to form a skeletal structure. The resulting skeletal structure may be used by itself or as a support for various coverings.

Figure 4:
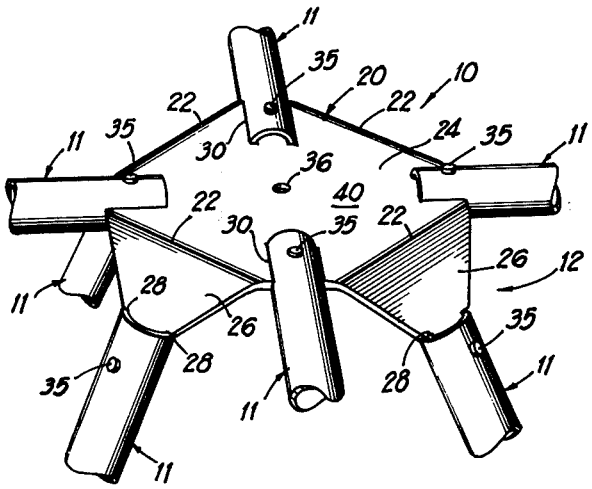
FIG. 4 is a perspective view showing one plate member being used as the connector.
Figure 5:
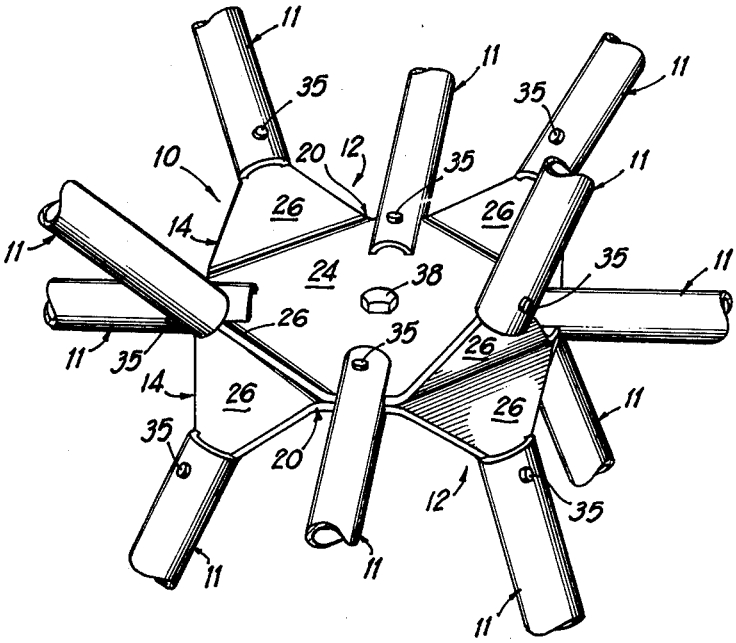
FIG. 5 is a perspective view showing two plate members being used as the connector.
Figure 6:
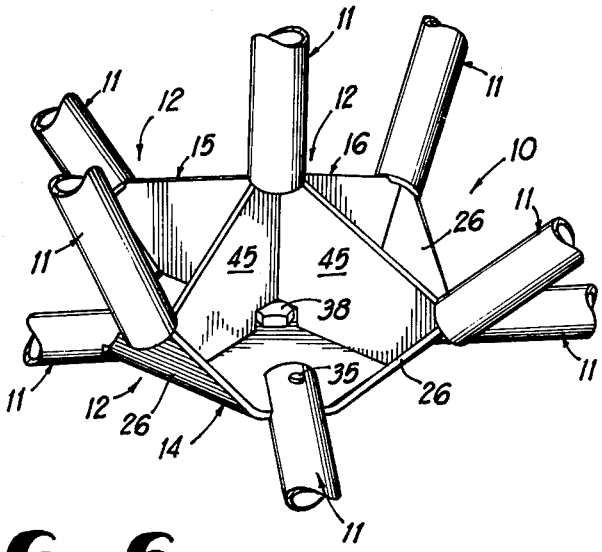
FIG. 6 is a perspective view showing the connector of FIG. 4 using additional plate members.

The connector 10 includes plate elements 12 which can be used individually or collectively to connect the tubular strut members 11. There are three types of plate members 12; base plates 14, outwardly slotted cross plates 15, and inwardly slotted cross plates 16. The base plates 14 may be used individually as seen in FIG. 4, in pairs as seen in FIG. 5; or in combinations with the cross plates 15 and/or 16 as seen in FIG. 6. Each of the base plates 14 has a central web 20 with a generally rectilinear configuration from the four corners of which project tangs 21 which are integral with the central web 20. It will be seen that the four tangs are oriented along tang axes $A_T$ which are oriented generally radially with respect to the plate axis $A_p$. It will further be seen that each of the tang axes are located 90° apart so that there are four tangs 21 on central web 20. It will further be seen that the central web 20 is bent along fold lines 22 which are spaced from the plate axis $A_p$ the distance $d_1$ with the fold lines 22 being perpindicular to the tang axis $A_T$ of the tang 21 that lies outboard of the fold line 22 associated therewith. This forms a central flat section 24 in the central web 20 which has a substantially square configuration and which is substantially bounded by the fold lines 22. Thus, it will be seen that while the central web 21 has a generally square configuration with its peripheral edges 25 located the distance $d_2$ from the central plate axis $A_p$, the central flat section 24 has its edges defined by the fold lines 22 located the distance $d_1$ from the central axis $A_p$ so that the central flat section 24 fits in the central web 20. The central web 20 has thus formed therein a plurality of bent planar sections 26 outboard of the fold lines 22 from which the tangs 21 extend outwardly. It will further be noted that the tangs 21 are coplanar with the bent sections 26 so that the bent sections 26 and tangs 21 define an included angle $A_1$ with the central flat section 24 and the central web 20. The angle $A_1$ is shown in the figures at 45° although other angles can be used. Thus, it will be seen that each of the tangs 21 extends outwardly and away from the central section 24 of central web 20 at about a 45° angle. The tangs 21 have a width $w_1$ and a length $L_1$. The bent sections 26 each define an outwardly projecting shoulder 28 which serves to limit the insertion of the strut numbers 11 on the tangs 21 as will become more apparent.

The flat central section 24 in the central web 20 of base plate 14 is provided with a plurality of pairs of strut slots 30 between adjacent bent sections 26 in the web 20. Each pair of slots 30 are centered on a slot axis $A_S$ which extends outward from and normal to the plate axis $A_p$ across section 24. Each slot axis $A_S$ is also centered between two of the tang axes $A_T$ so that the slots 30 are shifted 45° with respect to the tangs 21. Each pair of strut slots 30 form a tang section 31 therebetween with the width $w_1$ corresponding to the tang 21 and an effective length $L_2$. It will be noted that each of the slots 30 has a width $w_3$ which will just slidably receive the strut member side wall therein as will become apparent. Thus, it will be seen that the base plate 14 has four tangs 21 and four tang sections 31 with the tang sections 31 alternating with the tangs 21. The central web 20 and tangs 21 have a common thickness $t_1$ which is relatively thin.

It will thus be seen that the strut members 11 can be inserted over the tangs 21 and/or the tang sections 31 on the base plate 14 with the strut members 11 having an inside diameter $d_3$ such that the strut members 11 will just fit over the tang 21 or tang section 31. The side wall thickness of the strut members 11 is such that the side wall of the strut members 11 will be received in the strut slot 30 when the strut members 11 are inserted over the tang sections 31. Each of the tangs 21 and the tang sections 31 are provided with a locating hole 32 which is in registration with similar locating holes 34 in the end of the strut members 11 when the end of the strut member 11 bottoms out against the shoulders 28 at tangs 21 or the inboard ends of slots 30 at tang sections 31 so that locking pins 35 can be inserted through the holes 32 and 34 in registration to lock the ends of the strut members 11 onto the tangs 21 or tang sections 31.

Figure 1:
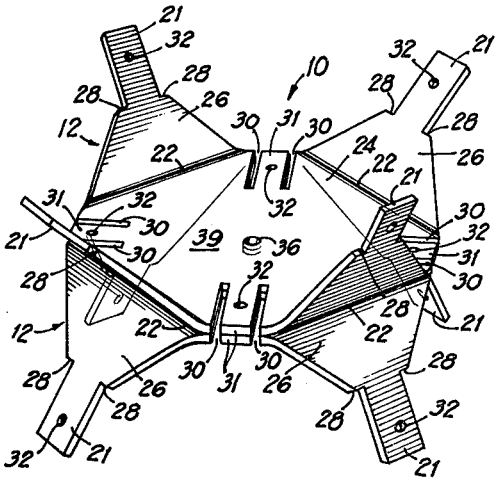
FIG. 1 is a perspective view illustrating one embodiment of the connector of the invention.

It will also be noted that the central web 20 of each of the base plates 14 is provided with a central attachment hole 36 so that two of the base plates 14 can be attached together with an attachment fastener 38 in order that a composite connector can be made using pairs of the base plates 14 as seen in FIGS. 1 and 5. The attachment hole 36 may also be used to attach the base plate 14 to a fixed support.

The outwardly and inwardly slotted cross plates 15 and 16 have the same peripheral configuration. Therefore, only the inwardly slotted cross plate 16 will be described in detail with like references being applied to corresponding elements of outwardly slotted cross plate 15.

The inwardly slotted cross plate 16 is designed to fit between opposed bent sections 26 and tangs 21 on the base plate 14. The cross plate 16 has a planar central web 45 with an inboard edge 46 having a length equal to twice the distance $d_1$ so that the inboard edge 46 will lie against the central flat section 24 of the central web 20 in the base plate 14. Opposed outwardly angled end edges 48 extend from opposite ends of the inboard edge 46 upwardly and outwardly therefrom and define an included angle $A_1$ with the inboard edge 46 so that when the cross plate 16 is placed against the central flat section 24 on base plate 14, the end edges 48 will lie along the bent sections 26 and the tangs 21 on these bent sections 26. The central web 45 at the outboard ends of the end edges 48 are provided with tang half sections 49 having a width $w_4$ which is equal to one-half the width $w_1$ of the tangs 21 minus one-half the thickness $t_1$ of the base plate 14 so that when the tang half sections 49 are placed against one of the tangs 21, the ends of the strut members 11 will fit over both the tang 21 and the tang half section 49 laying thereagainst. The inboard ends of each of the tang half sections 49 have a shoulder 50 formed in the central web 45 which corresponds to shoulders 28 on the bent sections 26 of the base plate 14. The central web 45 has a planar cross plate axis $A_{CP}$ and defines at that side of the central web 45 opposite the inboard edge 46, a tang 51 which corresponds in size and shape to the tangs 21 on the base plate 14. The shoulders 52 are defined in the central web 45 at the inboard end of the tang 51 which correspond to the shoulders 28 on the base plate 14. An appropriate cutout 54 is provided at the inboard edge 46 and centered on the cross plate axis $A_{CP}$ to clear the attachment fastener 38 if it is used to attach a pair of the base plates 14 together.

Figure 2:
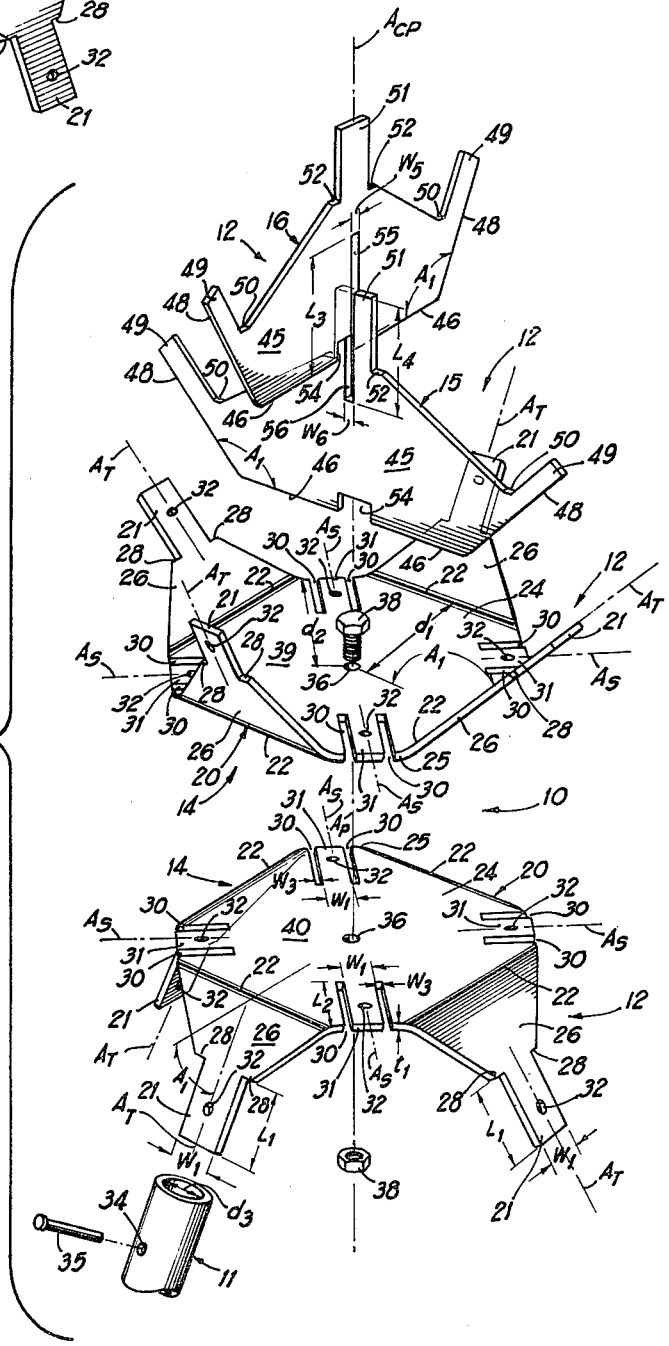
FIG. 2 is an exploded perspective view illustrating the connector of FIG. 1 with additional plate members.
Figure 3:
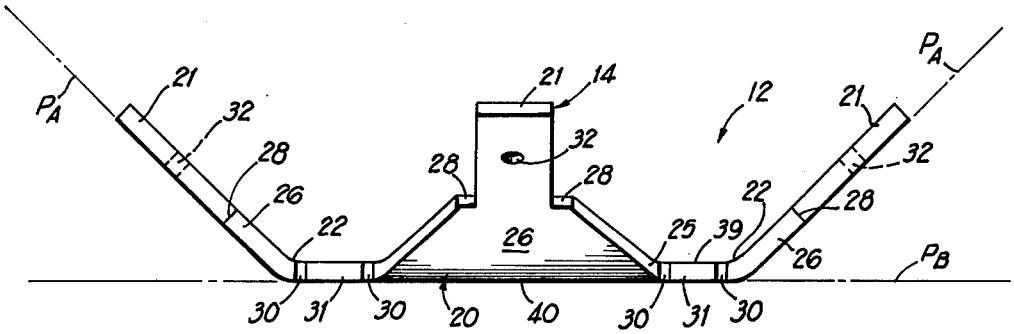
FIG. 3 is an enlarged side elevational view of one of the base plates of the connector.

The cross plate 16 is provided with a locating slot 55 which lies along the cross plate axis $A_{CP}$ and opens onto the cutout 54 in the inboard edge 46 of the central web 45. The locating slot 55 has a width $w_5$ about equal to the thickness of plate 15 and an effective length $L_3$ which is about half the distance between the inboard edge 46 on the central web 45 and the outboard end of the tang 51. The locating slot 55 is defined only in the central web 45 of the inwardly slotted cross plate 16. In the outwardly slotted cross plate 15, a complementary locating slot 56 is defined which lies along the cross plate axis $A_{CP}$ in the cross plate 15 but opens onto the outboard end of the tang 51 and extends inwardly therefrom. The slot 56 has a width $w_6$ which is equal to the thickness of the cross plate 16 and a length $L_4$ such that when the slots 55 and 56 in the plates 16 and 15 are inserted over each other as illustrated in FIGS. 2 and 6 until the inboard edges 46 of the plates 15 and 16 lie in a common plane, the inboard end of the slot 56 is in juxtaposition with the outboard end of the slot 55 so that the plates 15 and 16 are locked together and can be placed on one of the base plates 14 so that the tang half sections 49 line up with the tangs 21 on the base plate 14 as best seen in FIG. 6. It will also be noted that the tangs 51 on the cross plates 15 and 16 line up so that one of the strut members 11 can be inserted thereover as seen in FIG. 6. When the cross plate 15 and 16 are used either individually or interlocked together using the slots 55 and 56 as seen in FIG. 6, placement of the strut members 11 over the tangs 21 on the base plate 14 and the tang half sections 49 on the cross plates 15 and 16 will serve to lock the cross plates 15 and 16 onto the base plate 14.

The base plates 14 can be conceptually described as having a plurality of tangs 21 which lie in separate angle plans $P_A$ (FIG. 3) with a plurality of tang sections 31 which lie in a common base plane $P_B$ (FIG. 3) with the base plane $P_B$ normal to the plate axis $A_p$. All of the separate angle planes $P_C$ intersect the base plane $P_B$ and angle away from the base plane $P_B$ in the same direction so that one of the parallel side surfaces of the central flat section 24 in central web 20 is confined by the bent sections 26 and tangs 21. This confined side surface of section 24 has been designated 39 while the opposite side surface 40 is freely exposed. Two of the base plates 14 may be connected by placing the exposed side surfaces 40 on central flat sections 24 together, as seen in FIGS. 1 and 5. In some instances, it may be desirable to have some of the planes $P_A$ angle away from one side of the base plane $P_B$ while other of the planes $P_A$ angle away from the opposite side of the base plane $P_B$. In this case, it would not be feasible to connect two of the base plates 14 as seen in FIG. 1.

While the angles $A_1$ are illustrated at 45°, it is to be understood that these angles may be varied either individually or collectively. Where all of the angles $A_1$ are the same, however, the forces exerted on the base plate 10 will be directed toward a common point centered on the plate axis $A_p$.

Rather than forming tang sections 31 using slots 30, they may project outwardly beyond the central flat section 24 in a manner similar to the tangs 21 on the bent sections 26. Likewise, the tangs 21 may be formed similarly to the tang sections 31.

The plate members 12 and strut members 11 are shown as a transparent material such as plastic for sake of clarity. While these materials may be used in some applications such as toy and display structures, it is to be understood that a wide variety of materials such as metal, wood and ceramics may be used, especially where more strength is required.

I claim:

1. An interlocking structural system comprising:

a plurality of tubular strut members defining a cental opening in the ends thereof of a prescribed diameter; and, at least one connector for selectively interconnecting said plurality of tubular strut members, said connector including at least one base plate member, said base plate member having a plate axis and including a plurality of first tangs thereon lying in a common base plane normal to said plate axis and extending along first tang axes radially oriented with respect to said plate axis, and lying in said common base plane; and a plurality of second tangs thereon, each of said second tangs lying in a separate angle plane angled with respect to said common base plane and extending along second tang axes oriented generally radially with respect to said plate axis and lying in said angle plane; each of said first and second tangs having a size and shape such that the ends of said strut members will just slidably fit thereover so that those strut members inserted over said first tangs will be coaxially aligned with said first tang axes and those strut members inserted over said second tangs will be coaxially aligned with said second tang axes to angle outwardly and away from the common base plane.

2. The interlocking structural system of claim 1 wherein said first tangs on said base plate member are circumferentially spaced about said plate axis and wherein said second tangs on said base plate member are circumferentially spaced about said plate axis with said first and second tangs alternating circumferentially about said plate axis.

3. The interlocking structural system of claim 2 wherein said base plate member further includes a central web carrying said first and second tangs.

4. The interlocking structural system of claim 3 wherein said central web includes a flat central section having opposed parallel side surfaces lying generally along the common base plane and a plurality of bent sections integral with said flat central section, each of said bent sections lying along one of the separate angle planes and mounting one of said second tangs thereon coplanar therewith, and said first tangs integral with said flat central section and coplanar therewith.

5. The interlocking structural system of claim 4 wherein all of said bent sections and said second tangs angle away from the common base plane in the same direction so that one of said side surfaces of said flat central in the same direction so that one of said side surfaces of said flat central section on said central web is confined by said bent sections and said second tangs while the other side surface of said flat central section is exposed.

6. The interlocking structural system of claim 5 wherein said connector includes a pair of said base plate members and attachment means for connecting said pair of base plate members together so that the exposed sides of said flat central sections on said central webs of said base plate members are in juxtaposition with each other with said first tangs on one of said base plate members in registration with one of said first tangs on the other of said base plate members and with said second tangs on each of said base plate members angled away from the common base plane in the opposite direction from said second tangs on the other base plate member.

7. The interlocking structural system of claim 5 wherein said connector further includes at least one cross plate member adapted to extend diametrically across said base plate member between two of said bent sections and said second tangs which are diametrically opposed, said cross plate member including half tang sections thereon adapted to lie against said second tangs so that when one of said tubular strut members is inserted over said second tang and said half tang section lying thereagainst, said second tang and said half tang section support said tubular strut member holding said cross plate and said base plate assembled.

* * * * *